US005951823A

United States Patent [19]

Cabrera Y Lopez Caram et al.

[11] Patent Number: 5,951,823

[45] Date of Patent: Sep. 14, 1999

[54] VELOCITY INDUCED DRAINAGE METHOD AND UNIT

[75] Inventors: Luis Fernando Cabrera Y Lopez Caram, Cuernavaca, Mexico; Jeffrey P Bachand, Queensbury, N.Y.

[73] Assignees: Thermo Fibertek Inc., Waltham, Calif.; Smurfit Carton y Papel de Mexico, Polanco, Mexico

[21] Appl. No.: 09/168,808

[22] Filed: Oct. 8, 1998

Related U.S. Application Data

[62] Division of application No. 08/600,833, Feb. 13, 1996, Pat. No. 5,830,322.

[51] Int. Cl.[6] ..... D21F 1/54

[52] U.S. Cl. ..... 162/352; 162/374

[58] Field of Search ..... 162/351, 352, 162/374, 354

[56] References Cited

U.S. PATENT DOCUMENTS 4,559,105 12/1985 Sennett et al. ..... 162/352

4,687,549 8/1987 Kallmes ..... 162/352

4,789,433 12/1988 Fuchs ..... 162/352

4,838,996 6/1989 Kallmes ..... 162/352

*Primary Examiner*—Karen M. Hastings

*Attorney, Agent, or Firm*—Kane, Dalsimer, Sullivan, Kurucz, Levy, Eisele and Richard, LLP

[57] ABSTRACT

A drainage device and method which provides for drainage from paper or pulp stock on a fabric in a sheet or mat making machine which includes a primary blade and trail blade with a gap therebetween for drainage wherein the size of the gap controls drainage and the primary blade is so configured so as to force a portion of the drained liquid through the fabric to create paper stock activity and disbursement while minimizing turbulence and maintaining laminar flow in the machine direction along with providing reinforcement of CD shear.

4 Claims, 12 Drawing Sheets

VELOCITY INDUCED DRAINAGE METHOD AND UNIT

This is a divisional application of U.S. patent application Ser. No. 08/600,833 filed Feb. 13, 1996 now U.S. Pat. No. 5,830,322.

FIELD OF THE INVENTION

The present invention relates to a vacuum isolated drainage device and method therefore which is used in forming and dewatering of paper sheets and pulp mats, hereinafter papermaking.

BACKGROUND OF THE INVENTION

In general, it is well known in papermaking that the drainage of liquid from the paper stock on the fabric is an important step to insure a quality product. This is done through the use of drainage blades or foils usually located at the wet end of a Fourdrinier paper machine. (Note the term drainage blade as used herein is meant to include blades or foils that induce drainage or stock activity or both.) A wide variety of different designs for the blades is available. Typical blades provide for a bearing surface for the wire or fabric with a trailing portion for dewatering which angles away from the wire. This creates a gap between the blade surface and the fabric which causes a vacuum between the blade and the fabric. This not only drains water out of the fabric but also can result in pulling the fabric down. When the vacuum collapse the fabric returns to its position which can result in a pulse across the stock which may be desirable for stock distribution. The activity (caused by the wire deflection) and the amount of water drained from the sheet are directly related to vacuum generated by the blade (and therefore) to each other. Drainage and activity by such blades can be augmented by placing the blade or blades on a vacuum chamber. The direct relationship between drainage and activity is not desirable since while activity is always desirable, too much drainage early in the sheet formation process may have adverse effects on retention of fibers and filler. Rapid early drainage may also cause sheet sealing making subsequent water removal more difficult. Existing technology forces the paper maker to compromise desired activity in order to slow early drainage.

Drainage can be accomplished by way of a liquid to liquid transfer such as that taught in U.S. Pat. No. 3,823,062 to Ward. This reference teaches the removal of sudden pressure shocks to the stock. It is stated that controlled liquid to liquid drainage of water from the suspension is less violent then conventional drainage.

Similar type drainage is that taught in U.S. Pat. No. 5,242,547 to Corbellini. This patent teaches preventing the formation of a meniscus (air/water interface) on the surface of the forming fabric opposite the sheet to be drained. This reference achieves this by flooding the vacuum box structure containing the blade(s) and adjusting the draw off of the liquid by a control mechanism. It is referred to as "Submerged Drainage". Improved dewatering is said to occur through the use of sub-atmospheric pressure in the suction box.

In addition to drainage, blades are constructed to purposely create activity in the suspension to provide for desirable distribution of the flock. Such a blade is taught for example in U.S. Pat. No. 4,789,433 to Fuchs. This reference teaches the use of a wave shaped blade (preferably having a rough dewatering surface) to create microturbulence of the fiber suspension.

Other type blades wish to avoid turbulence yet effect drainage such as that described for example in U.S. Pat. No. 4,687,549 to Kallmes. This reference teaches filling the gap between the blade and the web. It is said that the absence of air prevents expansion and cavitation of the water in the gap and substantially eliminate any pressure pulses.

A number of other blades and arrangements can be found in the following prior art.

| | |
|---|---|
| 5,393,382 | 5,089,090 |
| 4,838,996 | 5,011,577 |
| 4,123,322 | 4,909,906 |
| 3,874,998 | 4,459,176 |
| 3,598,694 | 4,425,189 |
| 4,544,449 | 3,922,190 |
| 5,437,769 | 3,870,597 |
| 5,389,207 | 3,738,911 |
| 5,387,320 | |
| 5,169,500 | |

Present high and low speed paper machines produce different grades of paper with a wide range of basis weights. Sheet forming is a hydromechanical process and the motion of the fibers follow the motion of the fluid because the inertial force of an individual fiber is small compared to the viscous drag in the liquid. Formation and drainage elements effect three principle hydrodynamic processes, which are drainage, stock activity and oriented shear. Liquid is a substance that responds according to shear forces in or on it. Drainage is the flow through the wire, and its characterized by a flow velocity that is usually time dependant.

Stock activity, in an idealized sense, is the random fluctuation in flow velocity in the undrained fiber suspension, and generally appears due to a change in momentum in the flow due to deflection of the forming fabric in response to drainage forces or as being caused by blade configuration. The predominant effect of activity is to break down networks and to mobilize fibers in suspension. Oriented shear and activity are both shear-producing processes that differ only in their degree of orientation on a fairly large scale, that is, a scale that is large compared to the size of individual fibers.

Oriented shear is shear flow having a distinct and recognizable pattern in the undrained fiber suspension. Cross Direction ("CD") oriented shear improves both sheet formation and test. The primary mechanism for CD shear (on paper machines that do not shake) is the creation, collapse and subsequent recreation of well defines Machine Direction ("MD") ridges in the stock of the fabric. The source of these ridges may be the headbox rectifier roll, the head box slice lip (see International Application PCT WO95/30048 published Nov. 9, 1995) or a formation shower. The ridges collapse and reform at constant intervals depending upon machine speed and the mass above the forming fabric. This is referred to as CD shear inversion. The number of inversions and therefore the effect of CD shear is maximized if the fiber/water slurry maintains the maximum of its original kinetic energy and is subjected to drainage pulses located (in the MD) directly below the natural inversion points.

In any forming system, all these hydrodynamic processes may occur simultaneously. They are generally not uniformly distributed in either time or space, and they are not wholly independent of one another, they interact. In fact each of these processes contributes in more than one way to the overall system. Thus while the above mentioned prior art may contribute to some aspect of the hydrodynamic processes aforesaid they do not coordinate all processes in a relatively simple and effective way.

SUMMARY OF THE INVENTION

It is therefore a principal object of this invention to provide for a single device which provides for the three hydrodynamic processes; controlled drainage, activity generation and CD shear inversion, allowing each of the processes to be optimized independently of the others, and which is simple and effective.

It is a further object to provide for such a device which operates without reducing retention.

It is a yet further object to provide such a device which allows for a controlled drainage.

A yet further object is to provide such a device which isolates the forming fabric from air providing a controlled drainage and controlled stock activity.

A further object is to provide such a device that maximizes the number of CD shear inversions through blade design.

A further object is to provide such a device that needs a minimum amount of energy (kinetic) in order to provide the three hydrodynamic processes.

A further object is to provide for such a device for use in conjunction with an activity generating device.

The present invention controls drainage by restricting water flow from the sheet by passing the water through a gap formed between the primary drainage blade and a trail blade. It is desirable that the space between the forming fabric and the drainage blade (drainage zone) remains flooded at all times. The gap is sized based upon the ratio of the gap in the blade (through which all drained water must pass) to the MD width of the drainage zone created by the blade against the forming fabric. This ratio must be significantly smaller than what has previously been used in order to create a pressure drop between the drainage zone and the drainage box. Activity is controlled by the shape, angle and length of the primary blade while drainage is independently controlled by changing the width or position of the trail blade to open or close the gap between the two blades. The amount of drainage caused by the gap has been found to be relatively unaffected by either the blade shape or box vacuum whereas, heretofor, the latter were the primary vehicles used to control drainage.

Although application of an external vacuum source is not necessarily required for this invention, the use of a controlled vacuum in combination with the correct geometry provides a small amount of additional drainage control and may be used to affect sheet property including retention.

The gap width (MD) to the drainage zone width (MD) ratio will depend upon the volume of water desired to be drained and will therefore vary with machine speed, sheet weight and stock consistency. As aforesaid, this ratio will be significantly smaller than what would be used for a conventional drainage box under similar machine conditions. In conventional equipment ratios of between 0.5 and 1.0 are typical with ratios less than 0.25 extremely rare.

There are alternative ways (other than gap size) to restrict flow if it is desired to keep the drainage zone flooded. Baffles, gates, etc. might all be designed into the blades in order to control flow through the gap and hence the amount of water drained.

Operation may be enhanced using an activity inducing blade profile in the primary blade position. The use of the activity blade improves stock activity. Stock activity can also be enhanced by combining the use of a activity inducing device such as that taught in U.S. patent application Ser. No. 08/518,487; filed Aug. 23, 1995 entitled "Activity Induction in Papermaking".

In addition, pulsing of the sheet directly beneath a natural CD shear inversion point maximizes the number of inversions which occur. However, two practical problems have prevented papermakers from using this concept. First, the spacing of the CD inversions is a function of machine speed. It is not practical to change spacing of individual blades to match the natural inversion points at various machine speeds. Second, since these inversions occur every 3 to 8 inches in the machine direction (depending on the machine speed), packing traditional foil blades close together to give the requisite pulses, often drains too much water.

The invention addresses both of these issues. First, rather than change foil spacing, the invention provides multiple pulses using a single primary blade. If speed changes, the papermaker need only change the primary blade to reachieve proper alignment between the pulse and inversions. Second, since the drainage is controlled using gap size, blades can be used like the multiple step blade, without draining too much water.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENT

Figure 1A:
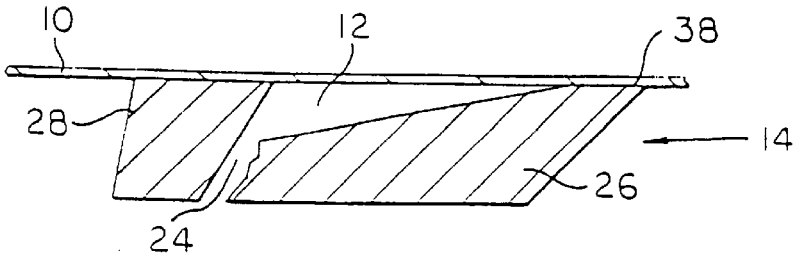
FIGS. 1A through 1E are side sectional views of drainage blades incorporation the teachings of the present invention.

Turning now more particularly to the drawings, FIGS. 1A to 1E show various configuration of a drainage blade or foil.

In this regard the space 12 between the fabric 10 and the blade sets (14–22) may be kept flooded at all times. This is achieved through the use of a gap 24 in the blades through which all water must pass. The blade sets as illustrated comprise a primary blade 26 followed by a trail blade 28. The space between the two defines the gap 24.

This gap 24 restricts water flow from the primary blade 26 (and hence the amount of water drained from the sheet) independently from and regardless of the amount of vacuum generated by the primary blade 26 and thereby controls the drainage. Using the gap size to control the amount of water drained independent of the applied drainage force (regardless of whether the drainage force is created by blade shape or box vacuum), gives the papermaker additional control. Heretofor, drainage forces are used both to drain water and to create activity. The papermaker must often sacrifice desired activity to reduce early table drainage and thereby maintain retention and prevent sheet sealing. Using a small gap, sized to restrict drainage to a desired level, allows the papermaker to use high drainage forces combined with wide MD fabric support spans to create activity.

Moreover the gap size may be readily changed by changing either the MD width or length of either of the primary or trailing blades to create a smaller or larger gap. This may be done by simply replacing either primary or trail blade with a larger or smaller MD length. Alternatively, rather than changing the blades, the blades (either or both) could be so mounted that they can be movable, changing the MD position of the blade(s) resulting in changing the gap size.

Figure 11A:
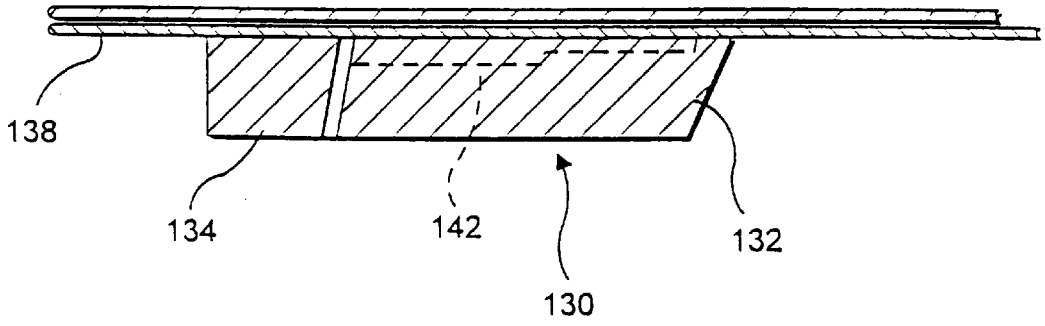
FIGS. 11A and 11B are respectively, a side end view of a step blade and a top plan view of the stock and wire crossing the blade.
Figure 11B:
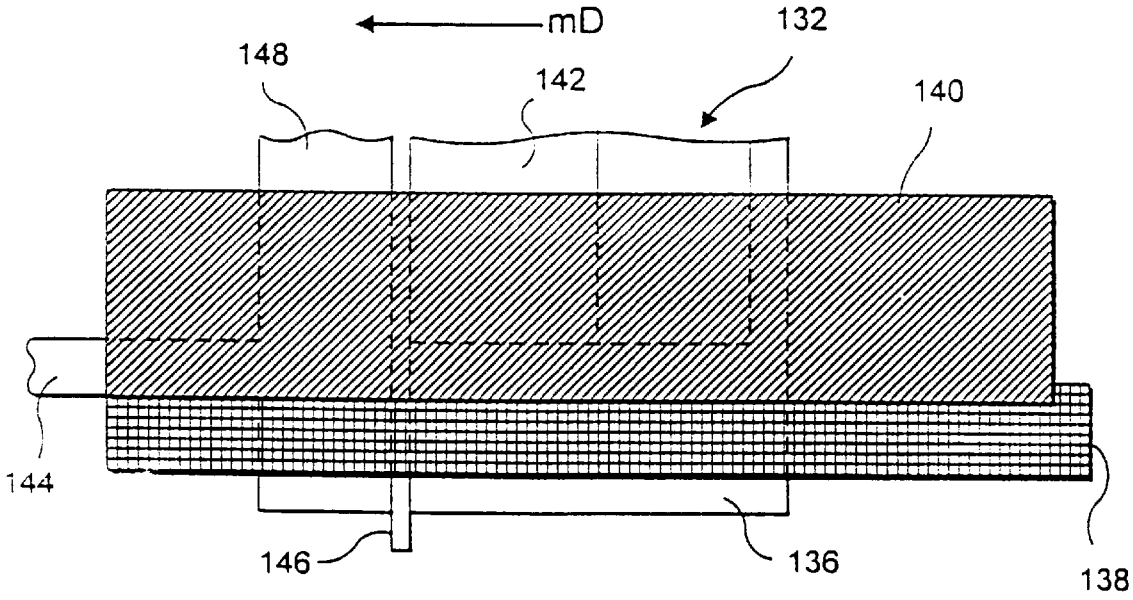

Note, as discussed more fully with regard to FIGS. 11A and 11B, the upper surfaces at the ends of the primary blade is horizontal and level with the plane of the fabric to prevent CD flow and an adjustable deckle is provided in the gap 24.

The space 12 between the blade sets (14–22) and the wire 10 creates a drainage zone. The ratio of the gap 24 to the MD width of the drainage zone controls the drainage and accordingly the flooding of space. The ratio used will depend upon the volume of water to be drained and the amount of stock activity desired (via wire motion or through liquid forced back up into the stock) and accordingly will vary with machine speed, sheet weight and stock consistency. Typically in conventional equipment the ratios are between 0.5 and 1.0. The present invention envisions a ratio much less than this.

Figure 1B:
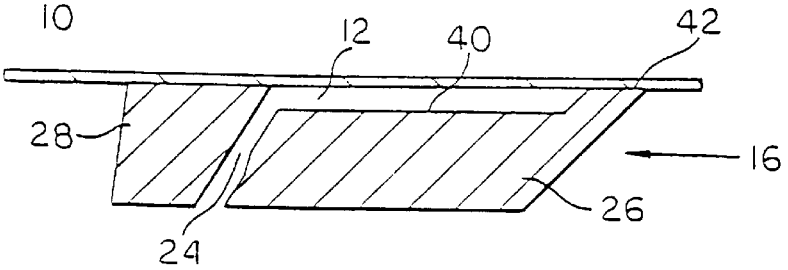
Figure 1C:
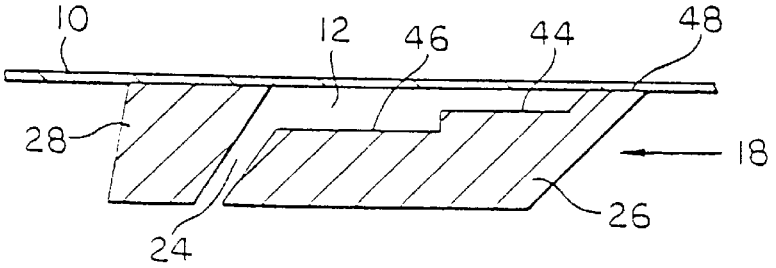

In FIG. 1A the primary blade 26 of blade set 14 is shown having an angle of 1° to 20° with respect to the leading edge 38 and the wire 10. In FIG. 1B the primary blade 26 of blade set 16 is shown as a single step with the drainage zone or recessed surface 40 from the leading edge 42 being approximately 0.030" to 0.100". FIG. 1C depicts a multiple step blade set 18 having steps 44 and 46 recessed from leading edge 48. The distance of these steps 44 and 46 from the leading edge 48 and further wire 10 is approximately 0.030" to 0.300" which may increase depending upon the number of steps. The sudden enlargement in the gap between the moving fabric and the foil surface at each step, creates a hydrodynamic pulse of sufficient magnitude to reinforce CD shear inversions as will be discussed later with regard to FIGS. 9 to 10B.

Figure 1D:
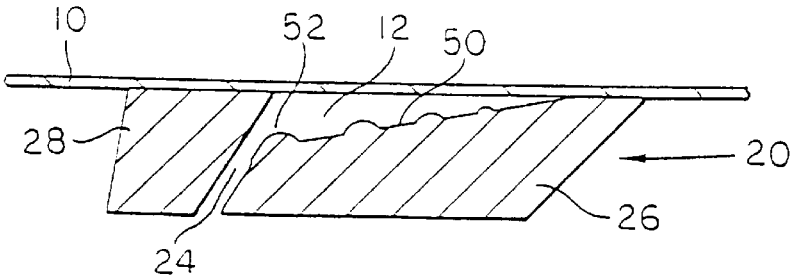

Turning now to figure 1D, there is shown a blade set 20 which illustrates representative geometry in the drainage zone to enhance activity generation in the sheet. Surface 50 is provided with illustrated curves 52 which will be discussed more fully with regard to FIGS. 3–4A. Blade set 20 is provided with a primary blade 26 and trailing blade 28 between which is a gap 24.

Figure 1E:
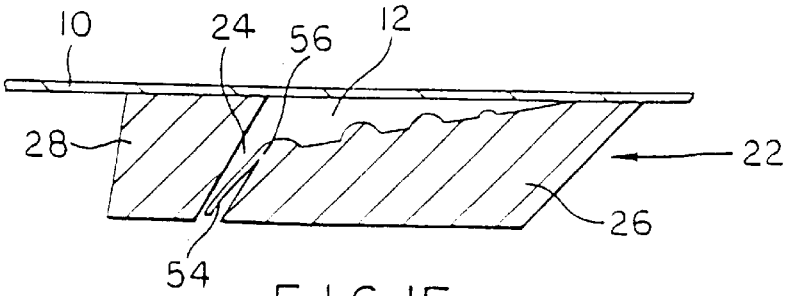

Blade set 22 shown in FIG. 1E is similar to blade set 20 with the exception that it is provided with a gate 54 which is hinged at 56 in the gap 24. Gate 54 freely swings across gap 24 to provide a means of maintaining flooding of the drainage zone and gap. The gate 54 may be made of plastic or other suitable material and may be mechanically hinged so as to be self compensating.

Figure 2:
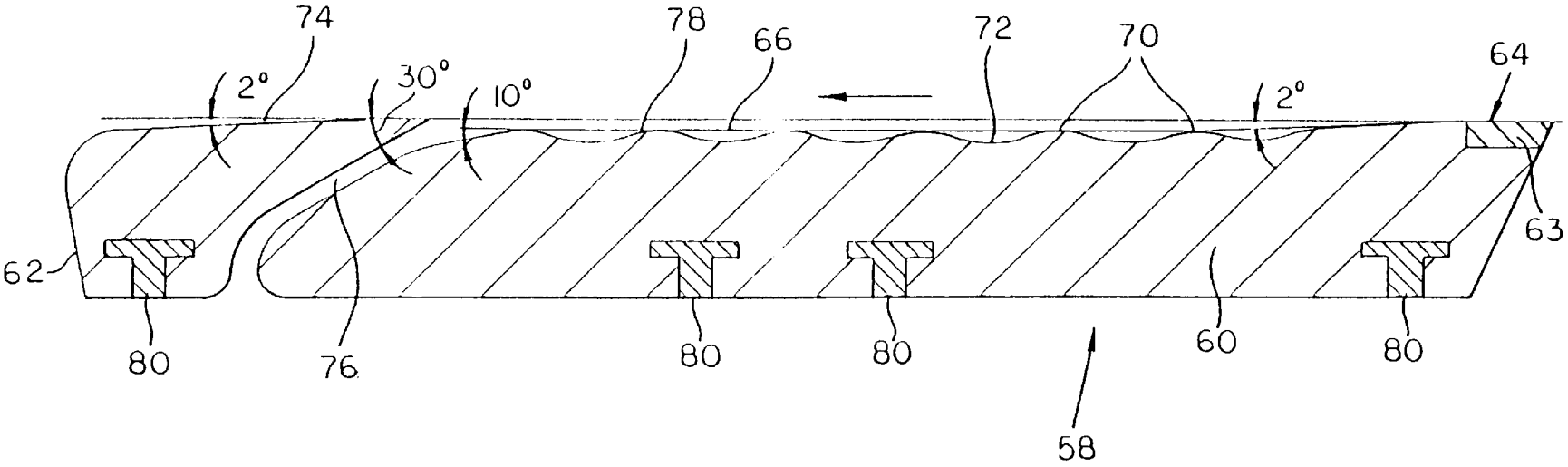
FIG. 2 is a side sectional view of a drainage blade incorporating the teachings of the present invention.

FIG. 2 depicts a more detailed representation of a blade or activity forming board 58. In this regard blade 58 comprises a primary blade 60 and a trail blade 62. Primary blade 60 included an insert 63 at its leading edge or landing area (1*a*) 64 which may be made of a ceramic or wear resistant material or other suitable material. The leading edge 64 provides a support surface for the wire or fabric 10 and is essentially flat and horizontal with respect thereto. Rearward of edge 64, the blade surface along line 66 diverges from the wire 10 at an angle of approximately 2°. The leading edge 64 is followed by a series of smoothly formed raised areas 70 and recesses 72 beginning at a spaced distance 71 therefrom. In blade 58 as shown the raised areas are approximately 1.5" apart from each other. As aforesaid depending upon the speed of the machine, the recesses 72 can be greater or less to provide the desired amount of back flow while maintaining laminar flow, as will be discussed.

Trail blade 62 is provided having an upper surface 74 which slopes downward away from the wire 10 at approximately a 2° angle. The entire blade 58 is, for example, approximately 16⅞" wide with the trail blade 62 being about 3⅞". The primary blade 60 has a surface of about 13" adjacent the wire 10. Formed between the primary blade 60 and trail blade 62 is a gap 76 which at its mid point is approximately 3/16" across.

Several conventional T mounts 80 are provided to slidably mount the blade 58 on a suction box and the like. The aforesaid dimensions, while desirable, are not critical. This gap 76 provides for drainage of liquid from the wire 10 and remains flooded during operation along with the space 78 between the primary blade 60 and wire 10. This will allow for a liquid to liquid transfer of water from the wire 10.

More importantly, the gap 76 size can be adjusted depending upon machine speed, etc. to achieve the desired amount of drainage. Using a narrow gap between the blades maximizes the drainage induced by a given drainage force by isolating the underside of the fabric from air by flooding the space between the wire and the blade. However, the primary factor which determines the amount of water drained from the sheet is gap size. By using small gaps, the amount of water drained is relatively unaffected by either blade shape or box vacuum level. This is quite different from conventional papermaking where drainage is highly related to blade parameters (blade type, angle, etc.) and to box vacuum level.

Figure 3A:
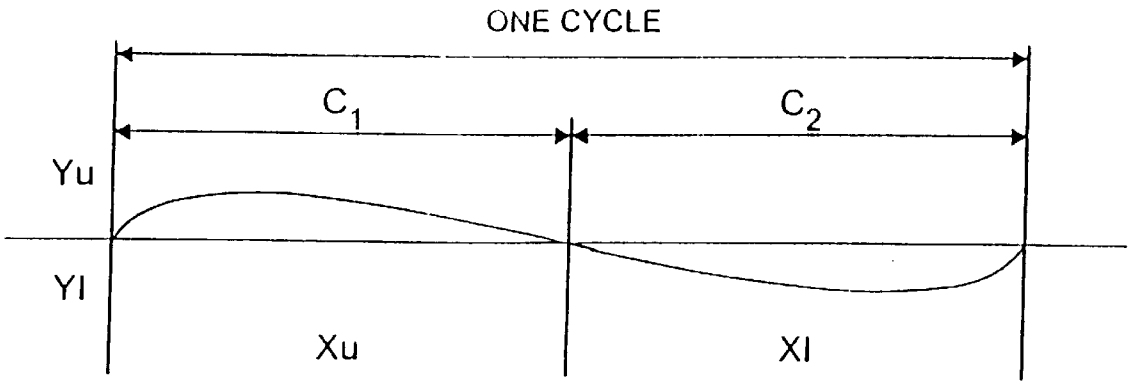
FIGS. 3 and 3A are respectively, a side sectional view of a drainage blade having one cycle indicated thereon with an enlargement hereof with parameters indicated.
Figure 3:
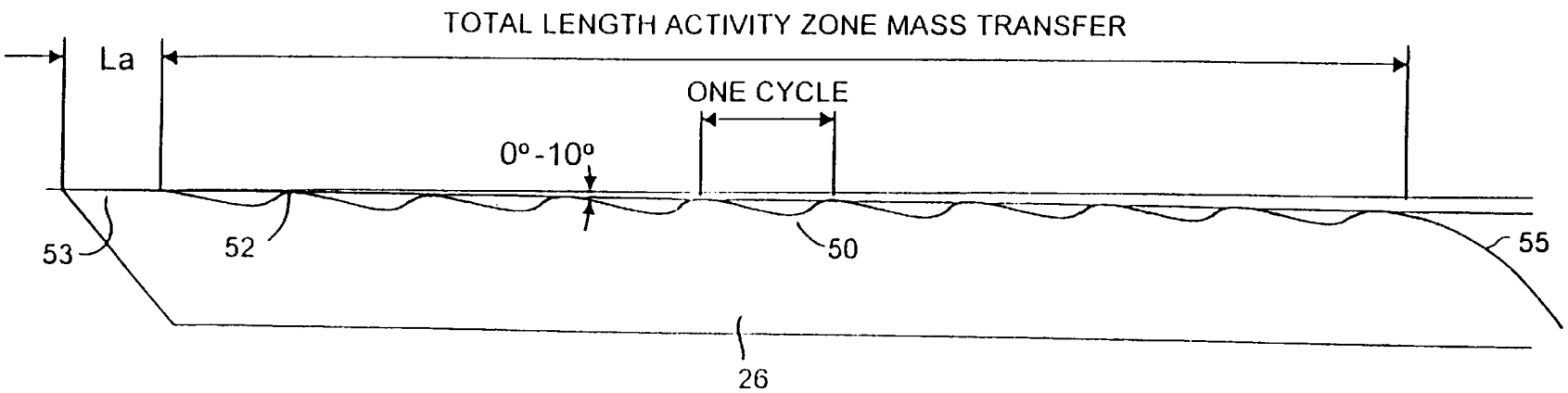
Figure 3B:
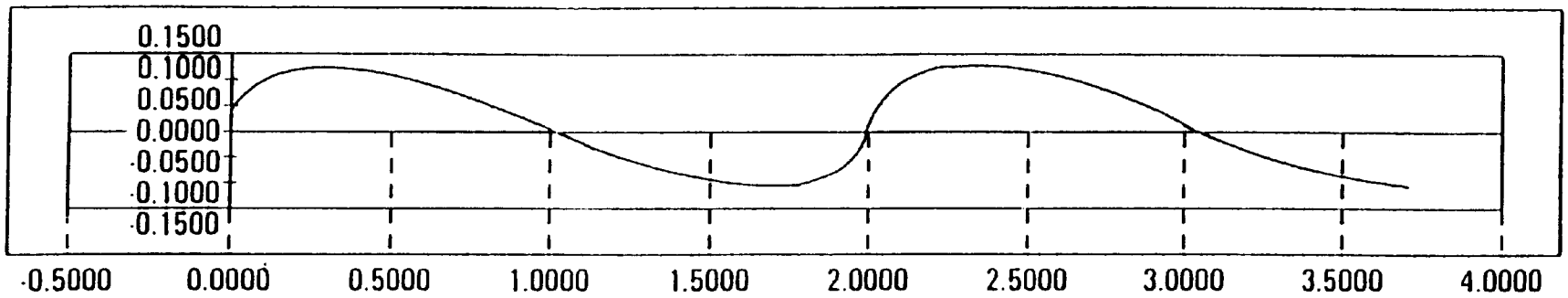
FIG. 3B is a graphical illustration of a profile of a portion of a blade surface, incorporating the teachings of the present invention.

Turning now to FIGS. 3 through 3B, these relate to the configuration of the blade surface 50 of the primary blade 26 of blade 20 previously described. In this regard FIG. 3 shows primary blade 26 having a series of raised curves 52. The angle formed between the landing area (1*a*) or flat leading edge 53 which supports the fabric or wire and the tangent of curves 52 may vary between 0 to 10°. The leading edge 53 can vary in length from 0.1 to 2 inches.

Generally, as can be seen in FIGS. 3A and b, the trailing surface of the primary blade is formed with raised protuberances and valleys so as to force a portion of entrained liquid back through the fabric to create activity in the stock to enhance stock distribution. A plurality of said valleys are created by the trailing surface sloping downward at an angle at a rate which decreases in the machine direction towards a horizontal and then increases at a upward rate at a greater angle than the angle of the downward slope to a point to form a raised protuberance. The trailing surface forming the valley is shown to be generally inverse and opposite to the slope of the trailing surface forming the protuberance. More particularly, FIG. 3A is an enlargement of the single cycle shown on FIG. 3. In general, the profiles and lengths of C1 and C2 are designed according to machine speed, basis weight and consistency. On the illustration, FIG. 3A, the items listed mean the following:

Xu x axis for C1 profile (mean X upper)

Xl x axis for C2 profile (mean X lower)

Yu y axis for C1 profile (mean Y upper)

Yl y axis for C2 profile (mean Y lower)

Also, in general, the length of the activity zone on blade surface 50 (i.e. that which extends from the leading edge 53 to the trailing edge 55) is designed according to the machine speed, basis weight, consistency, fiber type and intensity of the activity. The distance from the trailing edge 55 to the wire is designed according to the amount of water to be removed.

The blade surface 50 is specifically designed to maintain laminar flow of constant average velocity in the machine direction. Ideally, the dewatering surface 50 is as smooth as possible to minimize microturbulence at the blade surface. By maintaining laminar flow or very close to laminar flow, the invention maximizes the amount of energy returned to the sheet. A further benefit of minimizing turbulent flow (at or near the surface of the blade) is that turbulent flow consumes energy (increases drag load) while providing no benefit to sheet formation. That energy is supplied by the forming fabric and would be measured in terms of energy required to drive the fabric. Fluid is a substance that deforms continuously under the action of shearing forces. It is well known that the jet discharge from the headbox has some amount of kinetic energy. This energy could now be used to create and enhance the action of the shearing forces rather than the creation uncontrolled turbulence.

While maintaining laminar flow the curved surface of the blade induces vertical flow velocity (i.e. up throught the wire and stock) beneficial to formation. The geometry of the blade to provide this while maintaining near laminar flow may be determined and defined by well known fluid flow over foil principles and equations and as set forth in the publication "Theory of Wing Sections" by Ira H. Abbott and Albert E. Von Doenltoff published by Dover Publications, Inc., (including, particularly, pages 110–115) and "Incompressible Aerodynamics" edited by Bryan Thwaites and published by Dover Publications, Inc., (including, particularly, pages 42–56).

Turning now to FIG. 3B which shows, graphically, a desired profile of the blade surface 50 which is aimed at while creating stock activity by a back flow of drained water while maintaining laminar flow in the area between the fabric and the blade.

The following formulas may be used to determine a desired profile of the blade.

$$g = \frac{-1}{1-a}\cdot\left[a^2\cdot\left(\frac{1}{2}\cdot\ln(a)-\frac{1}{4}\right)+\frac{1}{4}\right]$$

$$h = \frac{1}{1-a}\cdot\left[\frac{1}{2}\cdot(1-a)^2\cdot\ln(1-a)-\frac{1}{4}\cdot(1-a)^2\right]+g$$

-continued $$yt = \frac{t}{0.2}\cdot\left(0.2969\sqrt{x}-0.126x-0.3516x^2+0.2843x^3-0.1015x^4\right)$$

$$yc = \frac{Cli}{2\cdot\pi\cdot(a+1)}\cdot\left[\frac{1}{1-a}\cdot\left[\frac{1}{2}\cdot\left(a-\frac{x}{c}\right)^2\cdot\ln\left(\left|a-\frac{x}{c}\right|\right)-\frac{1}{2}\cdot\left(1-\frac{x}{c}\right)^2\cdot\ln\left(1-\frac{x}{c}\right)+\frac{1}{4}\cdot\left(1-\frac{x}{c}\right)^2-\frac{1}{4}\cdot\left(a-\frac{x}{c}\right)^2\right]-\frac{x}{c}\cdot\ln\left(\frac{x}{c}\right)+g-h\cdot\frac{x}{c}\right]$$

$$\theta = \operatorname{atan}\left(\frac{dy}{dx}\right)$$

$$Xu = x - yt\cdot\sin(\theta) \qquad Yu = yc + yt\cdot\cos(\theta)$$

$$Xl = x + yt\cdot\sin(\theta) \qquad Yl = yc - yt\cdot\cos(\theta)$$

where

Cli is the Vacuum index

C is the Cord t is the Amplitude of the (Wave) Profile or Maximum Distance between Yu and Yl a is a factor of the Intensity or Attack (must be between 0–1) and depends upon machine velocity or speed The foregoing formulas allow the creation of a Z (or upward) direction of flow through the wire or fabric to create stock activity and maintain laminar flow resulting in the aforesaid advantage. Such laminar flow foil or blade profile to create such a flow can be ascertained through the principles and teachings of the two aforesaid publications.

Figure 4A:
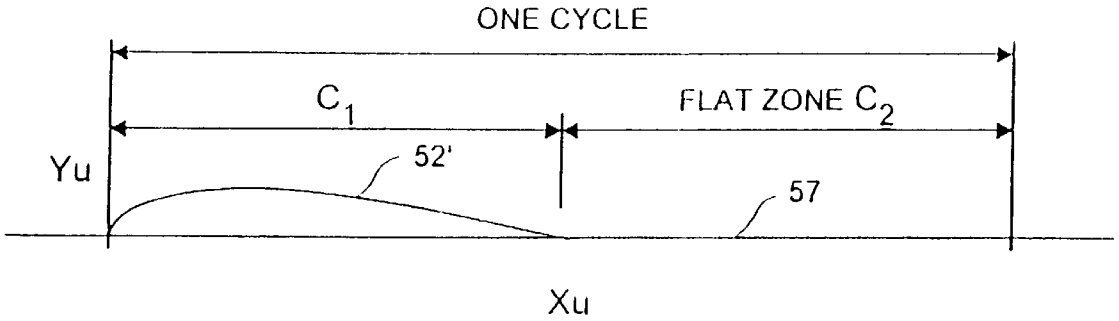
FIGS. 4 and 4A are respectively, a side sectional view of a differently configured drainage blade having a cycle indicated thereon with an enlargement thereof with parameters indicated.
Figure 4:
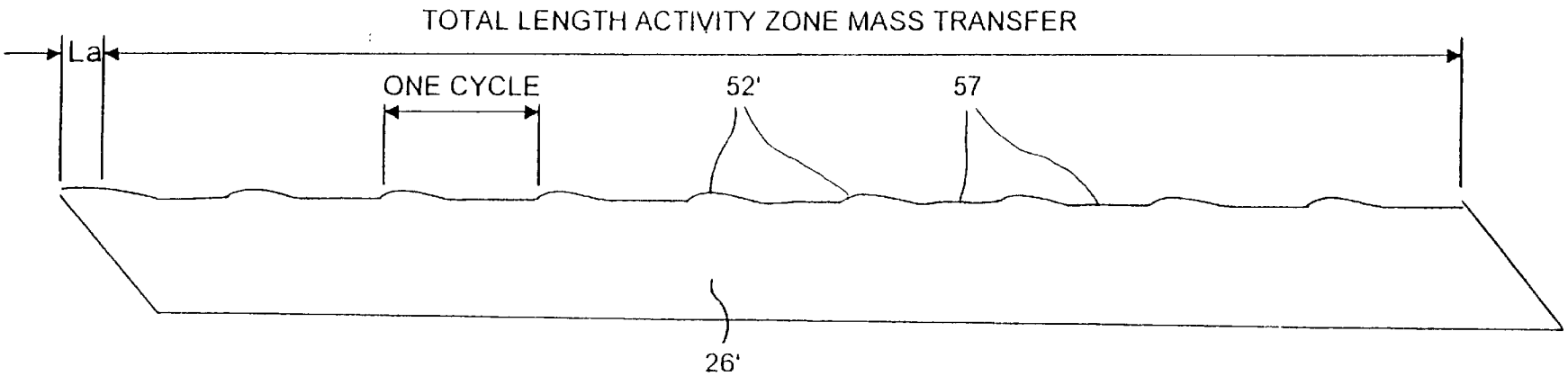

Turning now to FIGS. 4 and 4A which are similar to FIGS. 3 and 3A and set forth the profile of the primary blade 26'. In this embodiment, however, the profile includes a raised surface 52' followed by a flat surface 57. In all other respects, primary blade 26 of FIG. 3 and blade 26 are the same.

The flat zone 57 provides for less volume of drained water to be available to pulse or flow upward through the stock. Depending upon the particular application, less volume of upward flow may be desirable.

Figure 5:
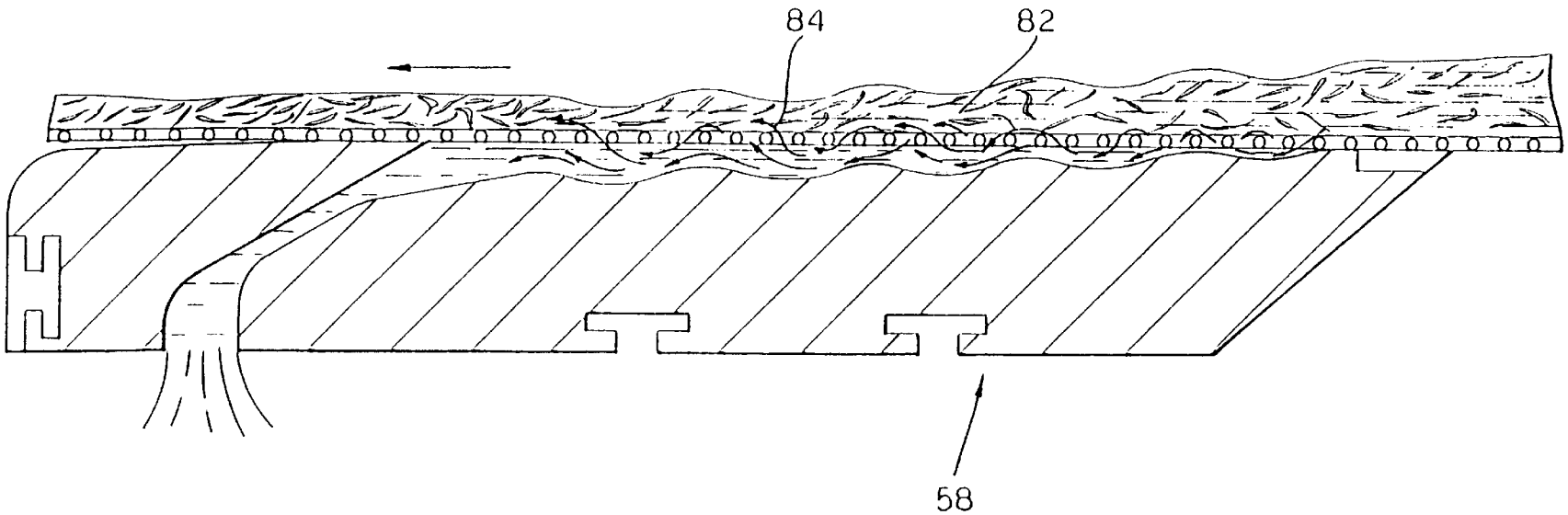
FIG. 5 is a side sectional view of a drainage blade with arrows representing the flow of fluid, incorporating the teachings of the present invention.

FIG. 5, generally, illustrates the expected flow pattern of the fluid drained from the paper stock 82 of material on the wire 10. Arrows 84 show the flow of liquid. As can be seen, a partial flow of liquid is caused to flow back through the wire 10 into the paper stock 84 causing activity and dispersion of the fibers 86 making up the paper stock 84.

Figure 6:
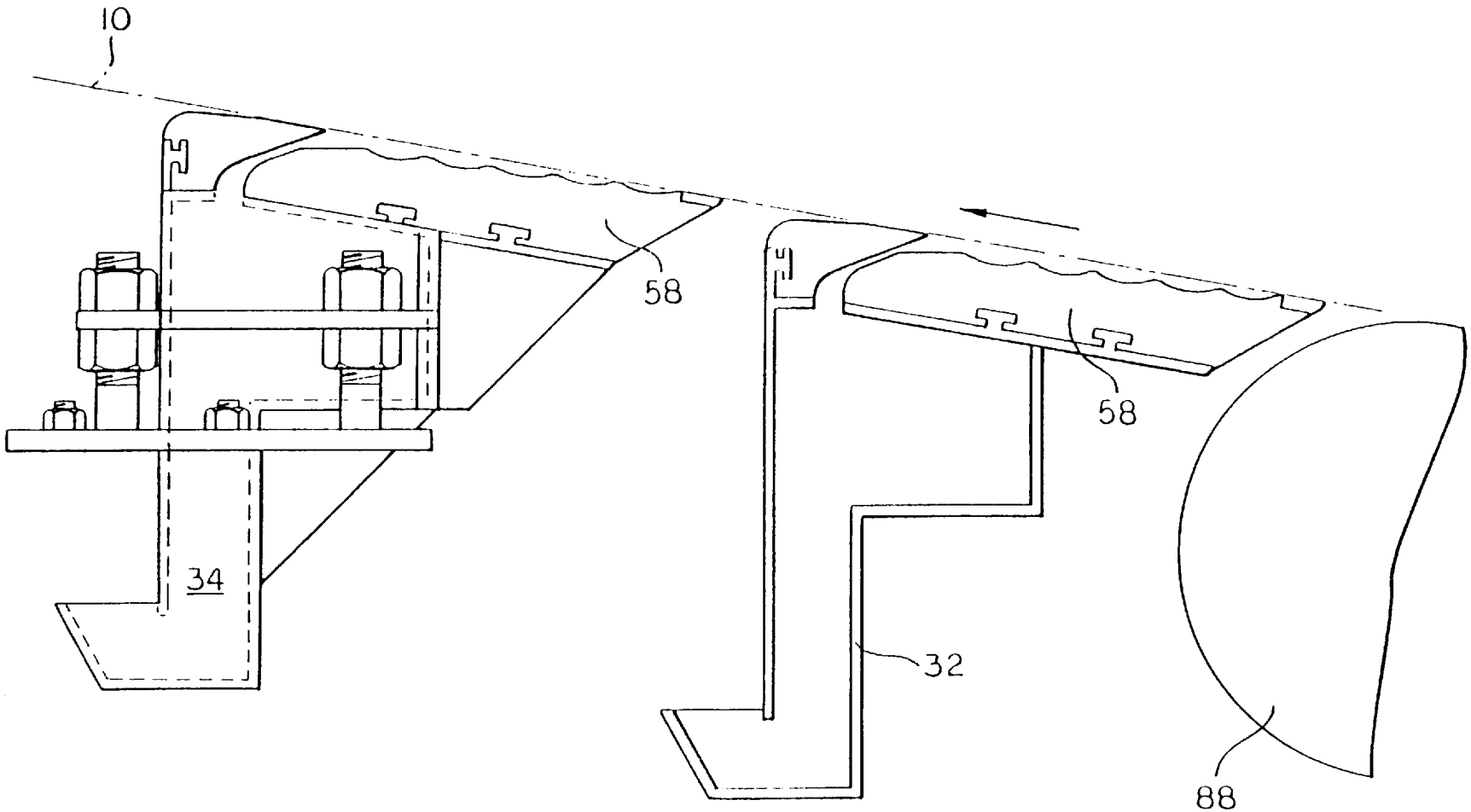
FIG. 6 is side sectional view of a pair of drainage blades located on respective suction boxes, incorporating the teachings of the present invention.

While the present invention may operate without the presence of external vacuum, or with limited vacuum as a primer during start up, blades of this type may be mounted on convention suction boxes 32 and 34 as shown in FIG. 6. In this regard a controlled vacuum could be provided to the suction boxes 32 and 34.

In the illustration shown the suction boxes 32 and 34 with blades follow a breast roll 88 and can operate on a non-horizontal wire 10.

Figure 7:
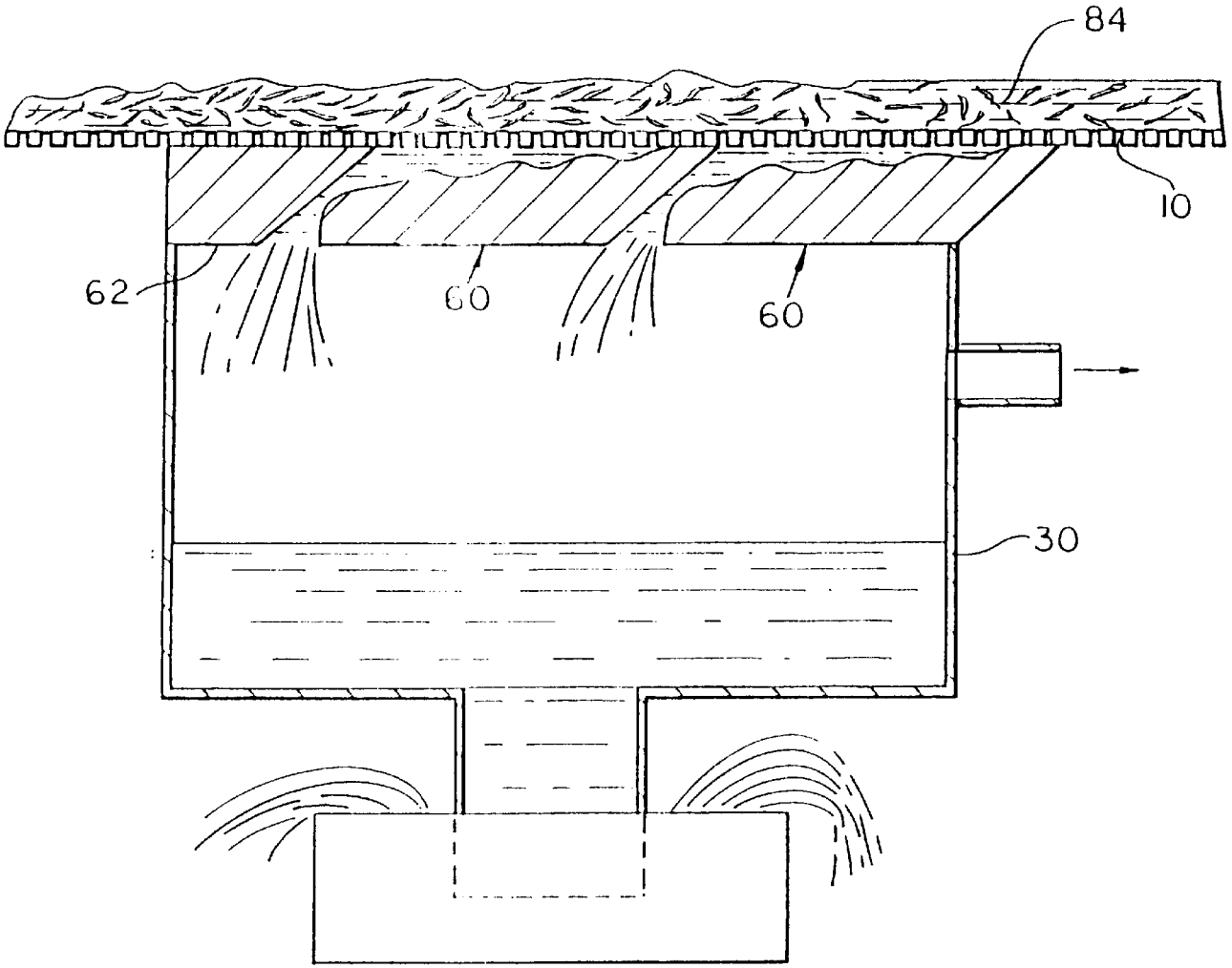
FIG. 7 is side sectional view of a pair of drainage blades located on a common suction box, incorporating the teachings of the present invention.

An alternative arrangement as shown in FIG. 7 could comprise a series of primary blades 60 with a single trail blade 62 mounted on a single suction box 36 which is coupled via outlet 90 to a controlled vacuum source.

While box vacuum has little (if any) affect on the amount of water drained, box vacuum still has an influence on the sheet as is evidenced by an effect on retention of the stock.

Figure 8:
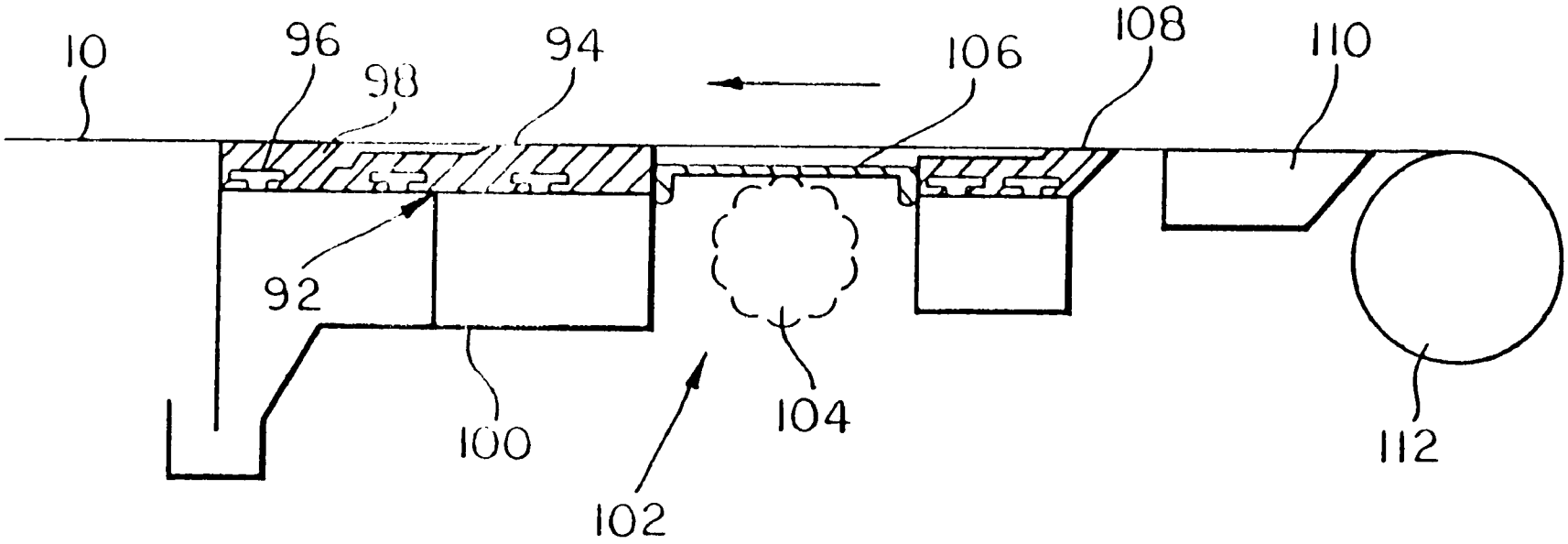
FIG. 8 is a side schematic view of a drainage blade used in association with an activity inducing device, incorporating the teachings of the present invention.

In addition, it may be desired to use the drainage blade in association with a separate activity generation device. In this regard in FIG. 8 there is shown a drainage blade 92 of the present invention. Blade 92 comprises a primary blade 94 with a trail blade 96 and a gap 98 therebetween. The blade 92 operates as aforesaid with the space between the primary blade 94 and the wire 10 and the gap 98 constantly flooded. Blade 92 is mounted on a conventional suction box 100 and is positioned subsequent to an activity generating device 102 as disclosed in U.S. Pat. No. 5,681,430 entitled "Activity Induction in Papermaking". This device comprises, in general, a mechanical roller 104 which upon rotation imports an impulse upon an unpermeable or semi impermeable member 106 which forms the bottom of a space between the forming wire and member 106 and which space is filled with liquid. This impulse in turn is conveyed by the liquid to the paper stock on the wire to create activity and dispersion. Conventional forming boards 108 and 110 are also shown along with a breast roll 112.

Figure 9A:
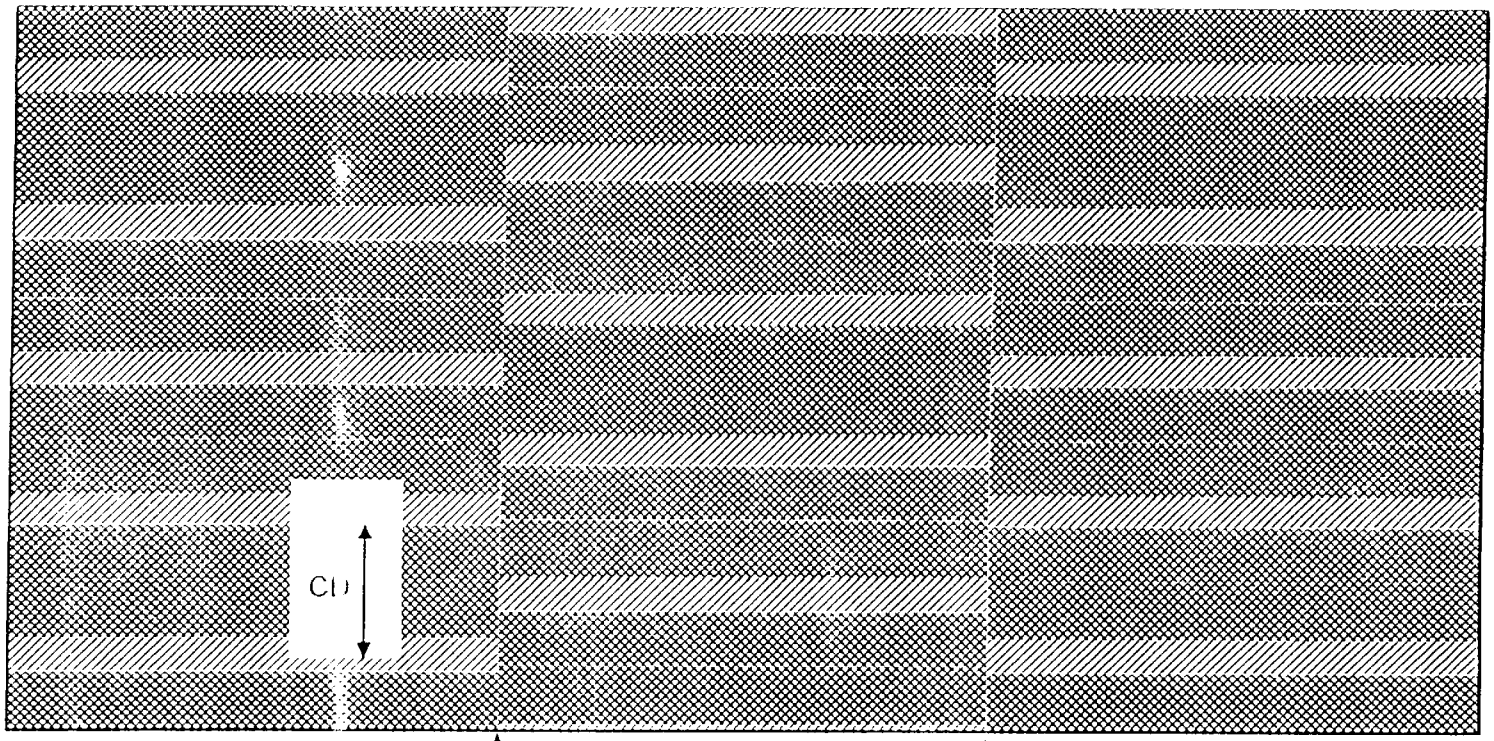
FIGS. 9 and 9A are respectively, a side sectional view of a step drainage blade and a top plan view of the stock on the blade illustrating CD shear inversions.
Figure 9:
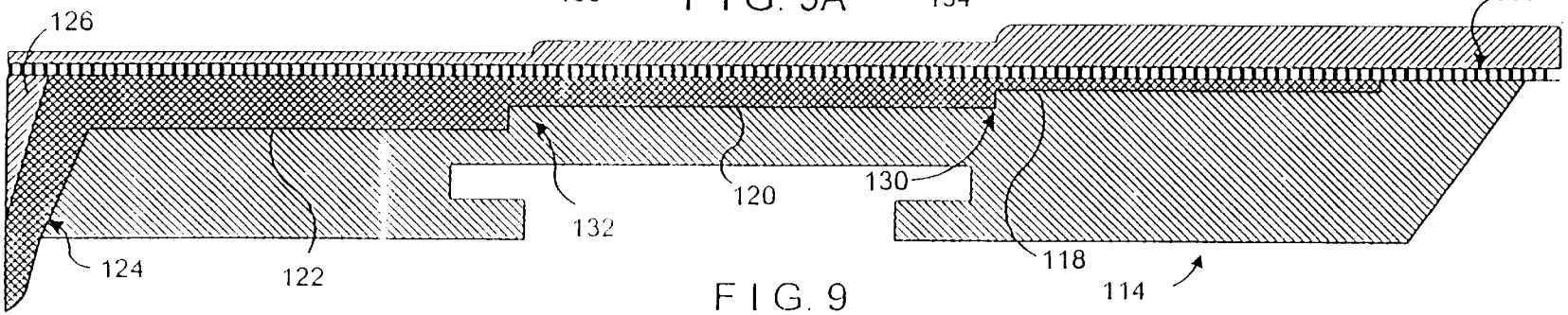

With regard to FIG. 9, there is shown a primary step blade 114 having a leading edge 116 and successive steps 118, 120 and 122. Gap 124 is formed between the primary blade 114 and the trailing blade 126. The blade 114 is designed to pulse the stock 128 at the points of natural CD inversion such as those shown at 130 and 132 on FIG. 9 and as reflect on the top view of the stock 128 at 134 and 136. Similar effect may be achieved with blades profiles in FIGS. 3–3A, 4–4A.

Figures 10A, 10B:
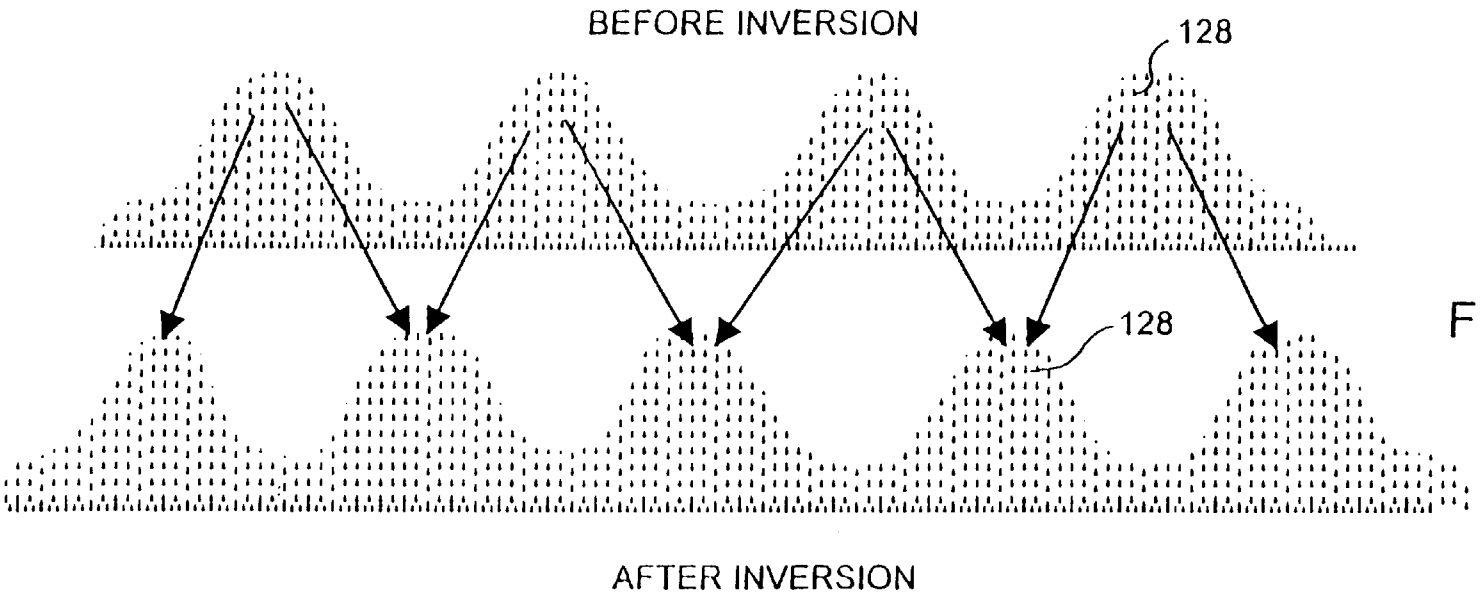
FIGS. 10A and 10B are cross-sectional illustrations in the MD direction of stock on a wire before and after CD shear inversion.

FIGS. 10A and 10B show a cross section of the stock 128 in the MD direction before and after CD shear inversion. While pulsing the sheet directly beneath a natural CD shear inversion point is known, maximizing the number of inversions which occur, has practical problems. The spacing of the CD inversions is a function of machine speed. It is not practical to change spacing of individual blades to match the natural inversion points at various machine speeds. Also, since these inversions occur every 3 to 8 inches in the machine direction (depending on machine speed), packing traditional foil blades close together to give the requisite pulses, often results in the drainage of too much water.

By the present invention both of these problems are avoided. First, rather than change foil spacing, the invention can provide multiple pulses using a single primary blade 114. If speed changes, the papermaker need only change the primary blade to reachieve proper alignment between the pulse and the inversions. Also, since drainage is controlled using gap 124 size, multiple step blades can be used without draining too much water too soon by adjusting the gap 124 size to limit and control drainage.

Turning now to figures 11A and 11B, as mentioned earlier, the ends of the primary blade must be level with plane of fabric (wire) to prevent CD flow of water due to back pressure created by gap. Likewise, the gap itself is sealed on both ends using deckle pieces that may be adjustably positioned in the CD direction so that the sheet is dewatered to its full trim width. FIGS. 11A and 11B illustrate this and show the blade set 130 comprising a step primary blade 132 and a trailing blade 134. The end portion 136 of primary blade 132 is flat and level with the plane of the fabric 138 containing the stock 140 thereon. As can be seen, the step portion 142 (shown in phantom) of the primary blade 132 begins at a spaced distance from the flat end portion 136 which is sufficiently large or wide enough to extend under typical trim width 144 (i.e. the portion of trim removed from the sheet by the papermaker). A deckle 146 is provided which is adjustable in the CD direction to allow sheet dewatering to its full trim width. The trailing blade 134 is shown having a flat horizonatal surface 148 which may instead be inclined. End sealing at the trailing blade 134 is not critical.

The opposite end of the blade set 130 would be similarly constructed to that shown in these figures.

Thus by the present invention its objects and advantages are realized and although a preferred embodiment has been disclosed and described in detail herein, its scope should not be limited thereby, rather its scope should be determined by that of the appended claims.

What is claimed:

1. A drainage device for use in a pulp or papermaking machine for drainage of liquid from pulp or paper stock contained on a fabric which passes over said device in a machine direction comprising:

a) a blade arrangement comprising a primary blade and a trail blade;

b) a gap formed between the primary blade and a trail blade to allow drainage of liquid therethrough;

c) said primary blade having a leading edge support surface adjacent the fabric for support thereof and a trailing surface that diverges downward from said support surface away from the fabric on the support surface so that a space is formed between said fabric and said trailing surface;

d) said trail blade having a leading edge support surface for the fabric;

e) said trailing surface of said primary blade being so formed with raised protuberances and valleys so as to force a portion of entrained liquid back through the fabric so as to create activity in the stock to enhance stock distribution; and f) a plurality of said valleys being created by said trailing surface sloping downward at an angle at a rate which decreases in the machine direction towards a horizontal to provide near laminar flow of the entrained liquid and then increases at a rate upward at a greater angle than the angle of the downward slope to a point to form a plurality of raised protuberances.

2. The device in accordance with claim 1 wherein the slope of the trailing surface forming the valleys is an inverse and mirror image of the slope of the trailing surface forming the protuberances.

3. The device in accordance with claim 1 wherein said blade surface profile conforms to aerodynamic principals of fluid flow over foil for laminar flow.

4. The device in accordance with claim 3 wherein the blade surface profile includes that of an aerodynamic foil.

* * * * *